US006269727B1

(12) United States Patent
Nigge

(10) Patent No.: US 6,269,727 B1
(45) Date of Patent: Aug. 7, 2001

(54) JUMP AND RECOIL COMPENSATOR FOR FIREARMS

(76) Inventor: Werner Nigge, Humboldstrasse 2b-4, D-67655 Kaiserslautern (DE)

( * ) Notice: Subject to any disclaimer, the term of this patent is extended or adjusted under 35 U.S.C. 154(b) by 0 days.

(21) Appl. No.: 09/472,024

(22) Filed: Dec. 27, 1999

Related U.S. Application Data

(63) Continuation-in-part of application No. 09/170,286, filed on Oct. 13, 1998.

(30) Foreign Application Priority Data

| | | |
|---|---|---|
| Oct. 11, 1997 | (DE) | 197 45 097 |
| Apr. 20, 1998 | (DE) | 198 17 513 |
| Jun. 13, 1998 | (DE) | 198 26 459 |
| Jul. 20, 1998 | (DE) | 198 32 477 |
| Dec. 24, 1998 | (DE) | 198 59 939 |

(51) Int. Cl.[7] ..... F41A 21/36
(52) U.S. Cl. ..... 89/14.3; D22/108
(58) Field of Search ..... 89/14.3, 14.05; 42/76.01; D22/108

(56) References Cited

U.S. PATENT DOCUMENTS

| | | | | |
|---|---|---|---|---|
| 1,369,085 | | 2/1921 | Craig | 89/14.3 |
| 3,603,202 | * | 9/1971 | Morague | 89/14.3 |
| 4,919,035 | * | 4/1990 | Pinkston et al. | 89/14.3 |
| 4,930,397 | * | 6/1990 | Seidler | 89/14.3 |
| 5,476,028 | * | 12/1995 | Seberger | 89/14.3 |

FOREIGN PATENT DOCUMENTS 38 31 766 C2 3/1990 (DE) .

* cited by examiner

*Primary Examiner*—J. Woodrow Eldred
(74) *Attorney, Agent, or Firm*—Venable; Norman N. Kunitz

(57) ABSTRACT

With respect to hand-held firearms, in particular automatic rifles, it is possible to eliminate the disadvantageous jump and to strongly reduce the recoil by a vertically disposed deflection plate that is provided with an opening for projectiles to pass through, that is mounted crosswise or transverse to the weapon barrel in front of the muzzle, and that is attached to the barrel via sheet metal guide plates disposed on respective lateral sides of the barrel to form open areas or surfaces toward the bottom and top. According to one embodiment the lower open surface is partially closed in its rear region. Instead of the partially closed area, a blocking surface or plate may be installed at a distance below the lower edge surface of the guide plates so that the combustion gases exit laterally. As an additional effect, the visibility of the muzzle flash is also reduced strongly, as well as the possible whirling up of leaves and dust.

3 Claims, 1 Drawing Sheet

JUMP AND RECOIL COMPENSATOR FOR FIREARMS

CROSS-REFERENCE TO RELATED APPLICATIONS

The present invention is a continuation in part of co-pending U.S. patent application Ser. No. 09/170,286, filed Oct. 13, 1998 pending, the subject matter of which is incorporated by reference.

This application claims the priority of German Patent Application Nos. DE 198 59 939.0, which was filed on Dec. 24, 1998, DE 198 32 477.4, which was filed on Jul. 20, 1998, DE 198 26 459.3, which was filed on Jun. 13, 1998, and DE 198 17 513.2, which was filed on Apr. 20, 1998, and DE 197 45 097.0, which was filed on Oct. 11, 1997, the subject matter of each of which is incorporated herein by reference.

BACKGROUND OF THE INVENTION

The present invention relates to an improved compensator arrangement for the jump or upward drift and the recoil of a firearm when fired.

The disadvantage of known, standard hand guns and small firearms (rifles, automatic rifles, machine guns, pistols and machine pistols) is that after each firing, the front of the barrel moves more or less upward in a "jump" while a more or less unpleasant recoil occurs at the same time.

With individual firings and semi-automatic multiple firings, the target is lost each time from sight and a renewed aiming is time-consuming. This is an even greater disadvantage with fully automatic rifles and pistols, meaning rapid-fire rifles, machine guns and machine pistols, since the firing accuracy worsens with each firing. The aforementioned jump of the barrel is the result of the recoil, caused by the expulsion of combustion gases from the muzzle. If the physical pressure curve of the recoil were to continue in the direction of the barrel and onto the supporting shoulder or, in the case of pistols, to the supporting hand, then an upward movement would be impossible. However, since the pressure curve in the barrel or shoulder support region experiences a downward turn in the direction of the shoulder, an upward movement at the end of the barrel must always occur as a result of the laws of physics. The same is true for pistols since the pressure curve of the pistol barrel also takes a downward turn toward the hand.

The known technical arrangements for counteracting this problem includes bores or slots in the upper frontal area of the barrel or in additional attachments on the front, which serve as jump compensators. However, these arrangements can only have small total cross sections because of the extremely high gas pressure in the barrel front and the front attachments to the barrel, which have only a slightly larger inside diameter, to avoid interfering with the projectile trajectory. Thus, the bores or slots have little effect on the jump.

Deflector or baffle plates that are provided with an opening for projectiles to pass through and are mounted crosswise or transverse in front of the tube muzzles are known for large guns or cannons. However, these do not reduce the jump, but only the tube recoil onto the gun carriage.

Semi-circular, curved blocking surfaces, which are installed in front of the muzzle and are designed to reduce or eliminate the jump are known from U.S. Pat. No. 1,369,085. However, since they are mounted at too short a distance to the projectile trajectory, the firing accuracy is reduced owing to the disturbing forces of the expanding combustion gases. In addition, these blocking surfaces are not long enough and not wide enough to eliminate the jump.

Forward-slanted deflection plates are known from the German Patent Specification DE 38 31 766 C2. However, based on statements therein, these plates only reduce the jump, meaning they do not eliminate it. The reason for this is that the combustion gases can escape all around in front of the deflector plates.

The above-identified U.S. patent application Ser. No. 09/170,286, filed Oct. 13, 1998, and corresponding German Patent Specification DE 197 45 097 C2, disclose as a variant, a forward-slanted deflector plate with sheet metal guide plates, mounted on the left and right side between the deflector plate and the barrel muzzle, and forming open areas at the top and bottom. As a result, the jump is eliminated completely and the recoil reduced strongly. U.S. patent application Ser. No. 09/170,286, likewise discloses a vertically installed or oriented deflector plate, as well guide plates forming open surfaces or areas at the top and bottom. However, the open area at the bottom is partially closed in the front region adjacent the deflection plate by a further plate. As a result, more combustion gases again escape toward the top than toward the bottom. In this case as well, the jump is eliminated completely and the recoil is eliminated to a large degree.

Despite the standard tube-shaped muzzle-flash dampers provided with slots, all military hand-held firearms still have the disadvantage, even with normal daylight, that the location of the gunner can be revealed by the brightness of the flash of fire at the muzzle. This is also true with respect to the above-mentioned arrangement of a vertically installed deflection plate with the partially closed top and bottom areas, wherein the muzzle flash does not exit in a forward direction, but rather exits upwardly and directly behind the deflector plate, even if it is somewhat reduced.

Accordingly, it is the object of the present invention to provide an effective improvement over the prior disclosed embodiments of such compensators and to reduce considerably the visibility of the muzzle flash of fire in addition to eliminating the jump and reducing the recoil.

SUMMARY OF THE INVENTION

The above object is achieved according to a first aspect of the present invention in that in a jump and recoil compensator for firearms comprising at least one baffle plate disposed transverse to a longitudinal axis of a gun barrel in front of a muzzle opening of the gun and having an opening for the passage of a projectile fired from the gun; and respective first and second guide plates, which are each attached to the baffle plate at one end and to the gun barrel at the opposite end, which extend rearwardly on respective lateral sides of the gun barrel and beyond the muzzle end of the gun such that open ends are formed between the guide plates toward the top and the bottom, the lower, open surface or area is closed off by a larger plate in the rear and not by a smaller plate in the front. The effect of this new type of arrangement is that the muzzle fire at the deflection plate escapes toward the top and the bottom, and experiences a small delay owing to this change in direction and thus, on the whole, is considerably less bright. No muzzle fire at all is visible in a forward direction as a result of the simultaneously exiting projectile. The result on the whole is that for all standard infantry ammunition types and under normal daylight conditions, the muzzle flash is no longer visible from a distance of more than 20 m, which fully meets the objective of the present improvement invention.

Furthermore, the jump continues to be eliminated completely, just as before. This is based on the fact that the gas pressure in the rear of the compensator area naturally is lower than the pressure directly behind the vertical deflection surface or baffle plate. However, a larger closing plate must be used there, as explained in the above, which can be adjusted easily to the respective weapon type and ammunition type, either through an increase or a reduction in size. The considerable reduction in the recoil continues.

A further disadvantage of all military hand-held firearms is that when these are fired near the ground, the combustion gases expand considerably immediately after leaving the muzzle. Thus, dry leaves or dust, if they are present, can also reveal the location of the gunner. The same is true with respect to the above-mentioned basic embodiments and improvements since combustion gases in that case also escape toward the bottom.

It is therefore a further object of the invention to counteract this effect by changing the direction of the share of combustion gas escaping downward, in such a way that a whirling up of leaves or dust cannot occur at all or only to a small degree.

This further object is achieved according to the present invention by a modification of the jump and recoil compensators as discussed above according to the first embodiment of the invention in that the lower, open surface or area is not partially closed off by a welded-in plate, but rather a blocking surface or plate is installed at a distance below the bottom edges of the laterally disposed guide plates such that combustion gases can escape on the sides, between the blocking surface or plate and the laterally mounted sheet-metal guide plates. To be sure, the direction taken by the combustion gases is not only toward the sides, but also downward at a slight angle. However, the intended purpose is served in that possibly whirled up material for all practical purposes is no longer visible.

If the plate is mounted at a far enough distance, then the actual function as a jump and recoil compensator is retained fully. Also, the adaptation to the respective weapon type and ammunition type occurs through an increase or decrease in this vertical distance.

DETAILED DESCRIPTION OF THE PREFERRED EMBODIMENTS

Figure 1:
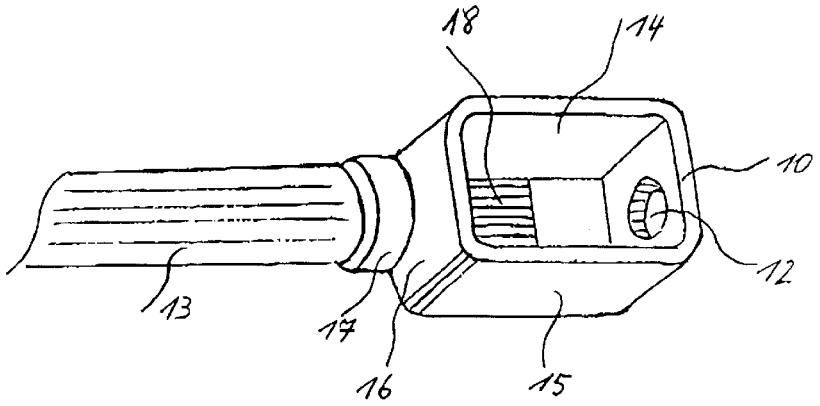
FIG. 1 is a perspective view of an improved jump and recoil compensator according to a first embodiment of the invention.

Referring now to FIG. 1, there is shown a first embodiment of an improved jump and recoil compensator according to the invention on the scale of 1:1. It is possible to produce this embodiment of the compensator, as shown, at extremely low cost from a rectangular section of a commercially available steel pipe with a rectangular cross section. In general, and in keeping with the terminology in the parent application, the invention will be described as though made from separate steel plates welded together.

As shown in FIG. 1, the jump and recoil compensator generally includes a front or baffle plate 10 having an opening 12 for the passage of a projectile, with the plate 10 being mounted crosswise or transverse to the longitudinal axis of a gun barrel 13, and in front of the muzzle end of the gun barrel. As shown, the baffle plate 10 is disposed vertically or perpendicular to the longitudinal axis of the barrel 13, and is maintained in its position by a pair of guide plates 14 and 15 disposed on either side of the gun barrel and fastened at their respective rear ends to a rear plate 16 likewise provided with an opening (not shown) for the passage of a projectile. The plate 16, as shown, is provided with a rearwardly extending collar 17, provided with an interior thread which can be screwed onto a corresponding outside thread at the muzzle end of the barrel 13. With the shown arrangement of the plates 10, 14, 15 and 16, a substantially rectangular member with openings existing between the guide plates 14 and 15 both to the top and to the bottom. As a result, combustion gases can escape only upwardly or downwardly when deflected by the baffle plate 10. According to the invention, a plate 18 is welded to the lower edges of the guide plates 14 and 15 to close off the rear area of the bottom opening between the guide plates 14 and 15.

With the embodiment of the invention shown in FIG. 1, the forward extent of the lower closing plate 18 is such as to eliminate the jump for the particular weapon in question. Moreover, compensation for the jump of light machine guns provided with a tri-pod support or gun mount can be achieved via a corresponding lengthening of the lower closing plate 18.

Figure 2:
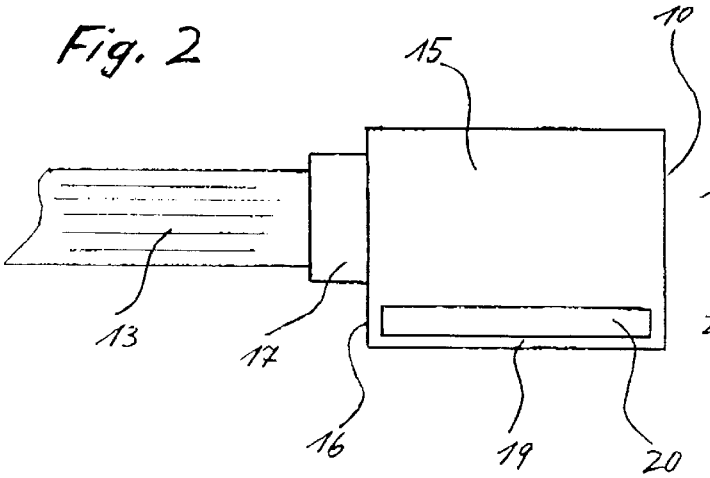
FIG. 2 is a side view of a further embodiment of a jump and recoil compensator for firearms according to the invention.
Figure 3:
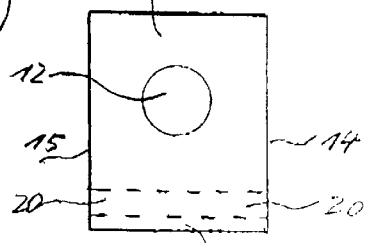
FIG. 3 is a front view of the jump and recoil compensator of FIG. 2.

Turning now to FIGS. 2 and 3, there is shown an exemplary second embodiment for practical use on a scale of 1:1 of a modification of the arrangement of FIG. 1 wherein the same reference numerals are used to indicate the same parts as in FIG. 1. In this second embodiment, the direction of the share of combustion gas escaping downward is changed such that the whirling up of leaves or dust does not occur or occurs only to a small degree. Again, this embodiment can be produced very cheaply from a rectangular section of commercially available steel pipe with a rectangular cross section. However, like the embodiment of FIG. 1, it will be described as essentially formed from steel plates which are welded together to form a rectangle.

As can be seen from FIGS. 2 and 3, in this embodiment instead of a forwardly extending bottom closing plate 18 closing off the bottom opening between the lateral guide plates 14 and 15, the front and rear plates 10 and 16 are extended downwardly, below the lower edges of the lateral guide plates 14 and 15, and a blocking plate 19 is welded to the lower edges of the plates 10 and 16. As a result, a respective laterally directed opening 20 is formed between the plate 19 and the lower edge of each of the guide plates 14 and 15. With this arrangement, the combustion gases exit laterally from the compensator, and not directly downwardly, thus avoiding the disturbance of dry leaves or dust which might reveal the location of a gunner when the weapon is fired near the ground.

Instead of the flat plate 19, a semicircular or similarly curved that is welded onto the lower edges of the baffle plate 10 and rear plate 16 can be used with the same effect.

The invention described above has the following advantages:

The jump is eliminated completely.

The recoil is reduced considerably.

The visibility of the muzzle flash is reduced to such a degree that for all practical purposes the location of the gunner cannot be detected from this.

The same is true with respect to the whirling up of dust and leaves.

An extremely low-cost production is possible because rectangular sections of commercially available steel pipe with rectangular cross section can be used for construction of the compensator.

The invention now being fully described, it will be apparent to one of ordinary skill in the art that many changes and modifications can be made thereto without departing from the spirit or scope of the invention as set forth herein.

What is claimed is:

1. A jump and recoil compensator for firearms comprising: a vertical deflection plate that is mounted transverse to a longitudinal axis of a weapon barrel in front of the muzzle opening of the barrel, is attached to the barrel and provided with an opening for the passage of a projectile fired by the weapon; first and second guide plates, each attached to the deflection plate at one end and to a rear plate mounted on the muzzle of the barrel at an opposite rear end, extending rearwardly on respective lateral sides of the barrel to at least the muzzle such that substantially rectangular open areas are formed between the guide plates toward the top and the bottom; and a blocking plate disposed below the guide plates and blocking at least a rear portion of the lower open area.

2. A jump and recoil compensator according to claim 1 wherein the blocking plate is directly fastened to respective lower edge surfaces of the guide plates to close the rear portion of the lower open area.

3. A jump and recoil compensator for firearms according to claim 1, wherein the blocking plate for the open area at the bottom is attached to lower edges of the deflection plate and the rear plate at a distance underneath the respective lower edge surfaces of the first and second guide plates so that lateral openings through which combustion gases can escape laterally are formed between an upper surface of the blocking plate and the lower edge surfaces of the guide plates.

* * * * *